US006158968A

United States Patent [19]

Nakamura

[11] Patent Number: 6,158,968

[45] Date of Patent: Dec. 12, 2000

[54] FLUID DISPLACEMENT APPARATUS WITH VARIABLE DISPLACEMENT MECHANISM

[75] Inventor: Shinji Nakamura, Isesaki, Japan

[73] Assignee: Sanden Corporation, Gunma, Japan

[21] Appl. No.: 09/049,997

[22] Filed: Mar. 30, 1998

[30] Foreign Application Priority Data

Mar. 31, 1997 [JP] Japan ..... P09-080554

[51] Int. Cl.[7] ..... F04B 1/26; F04B 9/00

[52] U.S. Cl. ..... 417/222.1; 92/138

[58] Field of Search ..... 417/222.1, 269; 92/138, 12.2

[56] References Cited

U.S. PATENT DOCUMENTS

| | | | |
|---|---|---|---|
| 4,175,915 | 11/1979 | Black et al. | 417/222.1 |
| 4,293,170 | 10/1981 | Brezosky | 308/161 |
| 4,425,837 | 1/1984 | Livesay | 417/269 |
| 4,553,905 | 11/1985 | Swain et al. | 417/222.1 |
| 4,664,604 | 5/1987 | Terauchi | 417/222.1 |
| 4,782,712 | 11/1988 | Takahashi et al. | 74/60 |
| 4,836,090 | 6/1989 | Smith | 92/12.2 |
| 4,872,815 | 10/1989 | Takai | 417/222.1 |
| 4,884,952 | 12/1989 | Kanamaru et al. | 417/222.1 |
| 5,055,004 | 10/1991 | Ebbing et al. | 417/222 R |
| 5,105,728 | 4/1992 | Hayase et al. | 92/71 |
| 5,259,736 | 11/1993 | Terauchi | 417/222.1 |
| 5,282,725 | 2/1994 | Shimizu | 417/222.1 |
| 5,316,446 | 5/1994 | Kimura et al. | 417/269 |
| 5,370,503 | 12/1994 | Terauchi | 417/222.1 |
| 5,425,303 | 6/1995 | Shimizu et al. | 92/12.2 |
| 5,785,503 | 7/1998 | Ota et al. | 417/269 |

FOREIGN PATENT DOCUMENTS

| | | |
|---|---|---|
| 0775824 | 5/1997 | European Pat. Off. . |
| 405172046A | 7/1993 | Japan . |

*Primary Examiner*—Henry C. Yuen
*Assistant Examiner*—Mahmoud M Gimie
*Attorney, Agent, or Firm*—Baker Botts L.L.P.

[57] ABSTRACT

A fluid displacement apparatus includes a cam rotor connected to a drive shaft and having a first arm extending therefrom. A plate is tiltably connected to the drive shaft. The plate has a surface disposed at an adjustable inclined angle relative to a plane perpendicular to the drive shaft and has a second arm extending therefrom. The plate and the piston are coupled, so that the pistons are driven in reciprocating motion within the cylinders upon nutation of the plate. A pin member is disposed in the second arm of the plate. An engaging device is disposed in the cam rotor. The pin member is slidably disposed in the engaging device, so that the cam rotor is coupled to the slant angle for permitting the inclination of the slant plate to vary.

10 Claims, 11 Drawing Sheets

FLUID DISPLACEMENT APPARATUS WITH VARIABLE DISPLACEMENT MECHANISM

BACKGROUND OF THE INVENTION

1. Field of the Invention

The present invention relates to a hinge mechanism of a fluid displacement apparatus. More particularly, it relates to a configuration of a hinge mechanism of a swash plate-type refrigerant compressor for use in automotive air conditioning systems.

2. Description of the Related Art

Generally, the compressor of an automobile air conditioner is driven by the engine of the automobile. The rotation frequency of the drive mechanism of the engine changes with time. The refrigerant capacity changes in proportion to the rotation frequency of the engine. Because the capacity of the evaporator and the condenser of the air conditioner does not change, when the compressor is driven at high rotation frequency, the compressor performs inefficiently. To avoid inefficiency, existing automobile air conditioning compressors are controlled by intermittent operation of the magnetic clutch. However, this results in a large load being intermittently applied to the automobile engine, One solution, to above mentioned problem is to control the capacity of the compressor in response to refrigeration requirements. One embodiment adjusts the capacity of a compressor, particularly a wobble plate-type compressor, as disclosed in the U.S. Pat. No. 4,664,604 to Terauchi. With reference to FIGS. 1 and 2, a refrigerant compressor includes a closed cylinder housing assembly 100 formed by annular casing 21, which has a cylinder block 23 and a hollow portion with a crank chamber 15, a front end plate 20, and a rear end plate 22. Front end plate 20 is mounted on the left end opening of annular casing 21 and closes the end of crank chamber 15. Front end plate 20 is fixed on annular casing 21 by a plurality of bolts (not shown). Rear end plate 22 and valve plate 24 are mounted on the opposite end of casing 21 by a plurality of bolts (not shown) to cover the end portion of cylinder block 23. An opening 20*a* is formed in front end plate 20 and receives drive shaft 3. An annular sleeve 20*b* projects from the front end surface of front end plate 20 and surrounds drive shaft 3 to define a shaft seal cavity 199. A drive shaft seal assembly 202 is assembled on drive shaft 3 within shaft seal cavity 199.

Drive shaft 3 is rotatable and supported by front end plate 20 through bearing 200. Bearing 200 disposed within opening 20*a*. The inner end of drive shaft 3 is provided with a rotor plate 9. Thrust needle bearing 201 is placed between the inner surface of front end plate 20 and the adjacent axial surface of rotor plate 9 to receive thrust load that acts against rotor plate 9. Thrust needle bearing 201 ensures smooth motion. The outer end of drive shaft 3 extends outwardly from sleeve 20*b* and is driven by the engine of a vehicle through a conventional pulley arrangement. The inner end of drive shaft 3 extends into a central bore 230 in the center portion of cylinder block 23 and is rotatably supported by a bearing, such as radial needle bearing 232. The axial position of drive shaft 3 may be adjusted by adjusting screw 233, which is screwed into a threaded portion of central bore 230. A spring device 234 is disposed between the axial end surface of drive shaft 3 and adjusting screw 233. A thrust needle bearing 235 is placed between drive shaft 3 and spring device 235 to ensure smooth rotation of drive shaft 3.

A spherical bush 8 is placed between rotor plate 9 and cylinder block 23. Spherical bush 8 may be slidably carried on drive shaft 3. Spherical bush 8 supports a slant or swash plate 4 for nutational (wobble) and rotational motion. A coil spring 10 surrounds drive shaft 3 and is placed between the end of rotor plate 9 and one axial surface of spherical bush 8 to push spherical bush 8 toward cylinder block 23.

Swash plate 4 is connected to rotor plate 9 with a hinge coupling mechanism that rotates in unison with rotor plate 9. Rotor plate 9 has an arm portion 9*a* projecting axially outward from one side surface. Swash plate 4 also has second arm portion 13 projecting toward arm portion 9*a* of rotor plate 9 from one side surface. As depicted in FIG. 1, second arm portion 13 is formed separately from swash plate 4 and is fixed on one side surface of swash plate 4. Arm portions 9*a* and 13 overlap each other and are connected to one another by a pin 11. Pin 11 extends into a rectangular shaped hole 13*a*, and into arm portion 9*a* of rotor plate 9. Pin hole 13*a* is formed through second arm portion 13 of swash plate 4. Thus, rotor plate 9 and swash plate 4 are hinged together. Pin 11 is slidably disposed in rectangular hole 13*a*. The sliding motion of pin 11 within rectangular hole 13*a* changes the slant angle of the inclined surface of swash plate 4.

Cylinder block 23 has a plurality of annular arranged cylinders 231 wherein pistons 50 slide. A typical arrangement may have five cylinders 231, but a different number of cylinders 231 may be provided. Each piston 50 comprises a head portion 50*a* slidably disposed within one of cylinders 231, a hollow portion 50*b* formed within head portion 50*a*, a connecting portion 52 and a rod portion 51. Rod portion 51 joins head portion 50*a* to connecting portion 52. Connecting portion 52 of piston 50 has a cutout portion 52*a* which straddles the outer peripheral portion of swash plate 4. Semi-spherical thrust bearing shoes 6 are disposed on each side of swash plate 4 and face the inner surface of connecting portion 52. This allows for sliding along the side surface of swash plate 4. The rotation of drive shaft 3 causes the swash plate 4 to rotate between bearing shoes 6 and to move the inclined surface axially to the right and left. The rotation of drive shaft 3 also reciprocates each piston 50 within cylinders 231.

Rear end plate 22 encloses a suction chamber 220 and discharge chamber 221. Valve plate member 24 and rear end plate 22 are fastened to cylinder block 23 by screws. A plurality of valved suction ports 24*a* may be connected between suction chamber 220 and cylinders 231, and a plurality of valved discharge ports 24*b* may be connected between discharge chamber 221 and cylinders 231. Gaskets 32 and 33 are placed between cylinder block 23 and valve plate 24, and between valve plate 24 and rear end plate 22, and seal the matching surfaces of cylinder block 23, valve plate 24 and rear end plate 22.

Further, another wobble plate compressor is disclosed in U.S. Pat. No. 5,165,863 to Taguchi. Referring to FIG. 2, compressor 500 includes cylindrical housing assembly 502 having a cylinder block 502*a* and a front housing 503 disposed at one end of cylinder block 502*a*. A crank chamber 510 is enclosed within cylinder block 502*a* by front housing 503. Rear end plate 531 is forward of crank chamber 510 and attached at the opposite end of cylinder block 502*a* by a plurality of bolts (not shown). Valve plate 530 is located between rear end plate 531 and cylinder block 502*a*. Opening 503*a* is centrally formed in front housing 503 for supporting drive shaft 509 with bearing 508 disposed therein. The inner portion of drive shaft 509 is disposed within the central bore of cylinder block 502*a* and rotatably supported by bearing 507. Bore 502*c* extends to the rear surface of cylinder block 502*a*.

Cam rotor 511 is fixed on drive shaft 509 by a pin member (not shown) and rotates with drive shaft 509. Thrust needle bearing 505 is disposed between the inner end surface of front housing 503 and the adjacent axial end surface of cam rotor 511. Cam rotor 511 has an arm 511*b* with a pin member 511*a* extending therefrom. Slant plate 513 is adjacent to cam rotor 511 and has an opening 513*a*. Drive shaft 509 is disposed through opening 513*a*. Slant plate 513 comprises an arm 512 having a slot 512*a*. Cam rotor 511 and slant plate 513 are connected by a pin member 511*a*. Pin member 511*a* is inserted in slot 512*a* to create a hinge joint, which connects cam rotor 511 and slant plate 513. Pin member 511*a* slides within slot 512*a* to allow adjustment of the angular position of slant plate 513 with respect to a plane perpendicular to the longitudinal axis of drive shaft 509.

Wobble plate 516 is nutatably mounted on hub 520 of slant plate 513 through bearings 517 and 518. Thus, slant plate 513 rotates with respect to wobble plate 516. Fork-shaped slider 525 is attached to a radially outer peripheral end of wobble plate 516 and is mounted on a sliding rail 524. Sliding rail 524 is disposed between front housing 503 and cylinder block 502*a*. Fork-shaped slider 525 prevents the rotation of wobble plate 516 when wobble plate 516 nutates along rail 524. Cylinder block 502*a* may have a plurality of cylinder chambers 522 wherein pistons 523 are disposed. Each of pistons 523 is connected to wobble plate 516 by a corresponding connection rod 515. Accordingly, nutation of wobble plate 516 causes pistons 523 to reciprocate within their respective chambers 522.

Rear end plate 531 may have a peripherally located annular suction chamber 532 and a centrally located discharge chamber 538. Valve plate 530 may have a plurality of valved suction ports 534 linking suction chamber 532 with cylinder chambers 522. Valve plate 530 has a plurality of valve discharge ports 535 linking a discharge chamber 533 with cylinder chambers 522. Suction ports 534 and discharge ports 535 are provided with suitable reed valves (not shown).

Suction chamber 532 may have an inlet portion (not shown) of an external cooling circuit. Discharge chamber 533 may have an outlet portion (not shown) connected to a condenser (not shown) of the cooling circuit. A valve retainer 536 is fixed on a central region of the outer surface of valve plate 530 by bolts 537 and nut 538. Valve retainer 536 prevents excessive bend of the reed valve at discharge port 535 during compression strokes of piston 523. Rear end plate 531 has a capacity control mechanism 540 disposed within a space 542. Capacity control mechanism 540 controls the pressure of crank chamber 510 by regulating the volume of discharge gas that is introduced into the crank chamber 510. The stroke length of the pistons, and, thus, the capacity of the compressor, may be changed by adjusting the slant angle of the wobble plate. The slant angle is changed in response to the pressure differential between the suction chamber and the crank chamber.

Compressors 100 and 500 in the above-mentioned references have elongated slots 13*a* and 512*a* formed in arms 13 and 512, respectively. Arms 13 and 512 are connected to rotor 9 of swash plate 4 and rotor 511 of slant plate 513. Further, rotors 9 and 511 are coupled with swash plate 4 and slant plate 513, such that pins 11 and 511*a* may be slidably disposed in slots 13*a* and 512*a* by employing a washer member. Therefore, the arrangements are fairly complex in production. Further, because elongated slots 13*a* and 512*a* are formed by a piercing process with machinery, this arrangement is not simple to manufacture and has a high assembling cost.

Further, during the compression and suction stages of these compressors, pins 11 and 511*a* are axially subjected to the compression reaction force from the pistons. Thus, it is undesirable that bush 8 and cylindrical sleeve 555 are axially subjected to the excessive force, although bush 8 and cylindrical sleeve 555 are supported by the compression reaction force.

One approach to resolve the problem is to expand the widths of elongated slots 13*a* and 512*a* in order to intensify the engaging between pins 11/511*a* and slots 13*a*/512*a*. However, expanding the widths of elongated slots 13*a* and 512*a* is limited by the design of the compressor.

SUMMARY OF THE INVENTION

It is an object of the present invention to provide a fluid displacement apparatus with a hinge mechanism.

It is another object of the present invention to provide a fluid displacement apparatus which may be assembled at a reduced cost.

It is a further object of the present invention to provide a fluid displacement apparatus which generates reduced noise and vibration during operations.

According to the present invention, a fluid displacement apparatus comprises a housing enclosing a crank chamber, a suction chamber and a discharge chamber. A plurality of cylinders are formed in the housing. A plurality of pistons, wherein each is slidably disposed within one of the cylinders such that the piston reciprocates within the cylinder. A drive shaft is rotatably supported in the housing. A cam rotor is fixedly connected to the drive shaft and has a first arm extending therefrom. A plate is tiltably connected to the drive shaft. The plate has a surface disposed at an adjustable inclined angle relative to a plane perpendicular to the drive shaft and has a second arm extending therefrom. A coupling means couples the plate to the pistons such that the pistons are driven in a reciprocating motion within the cylinders upon nutation of the plate. A pin member is disposed in the second arm of the plate. An engaging device is disposed within the cam rotor. The pin member is slidably disposed within the engaging device, such that the cam rotor is coupled to the slant angle for permitting a variable inclination of the slant plate to vary.

Further objects, features, and advantages of this invention will be understood from the following detailed description of preferred embodiments with reference to the attached drawings.

BRIEF DESCRIPTION OF THE DRAWINGS

For a more complete understanding of the present invention and its advantages, reference is now made to the following description taken in conjunction with the accompanying drawings, wherein like reference numerals represent like parts.

DETAILED DESCRIPTION OF PREFERRED EMBODIMENTS

Figure 1:
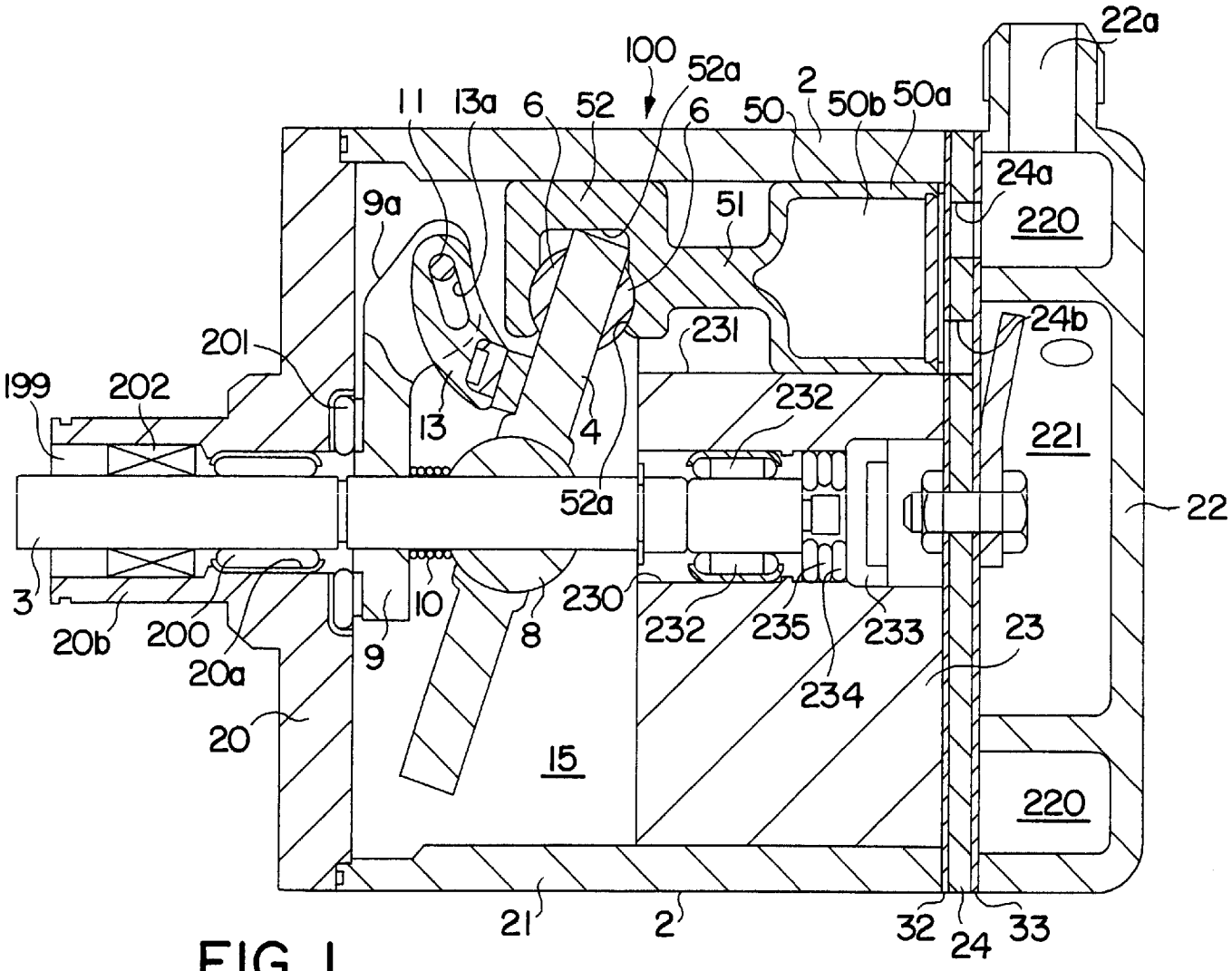
FIG. 1 PRIOR ART
FIG. 1 is a longitudinal cross-section view of a swash plate type refrigerant compressor in accordance with prior art.
Figure 2:
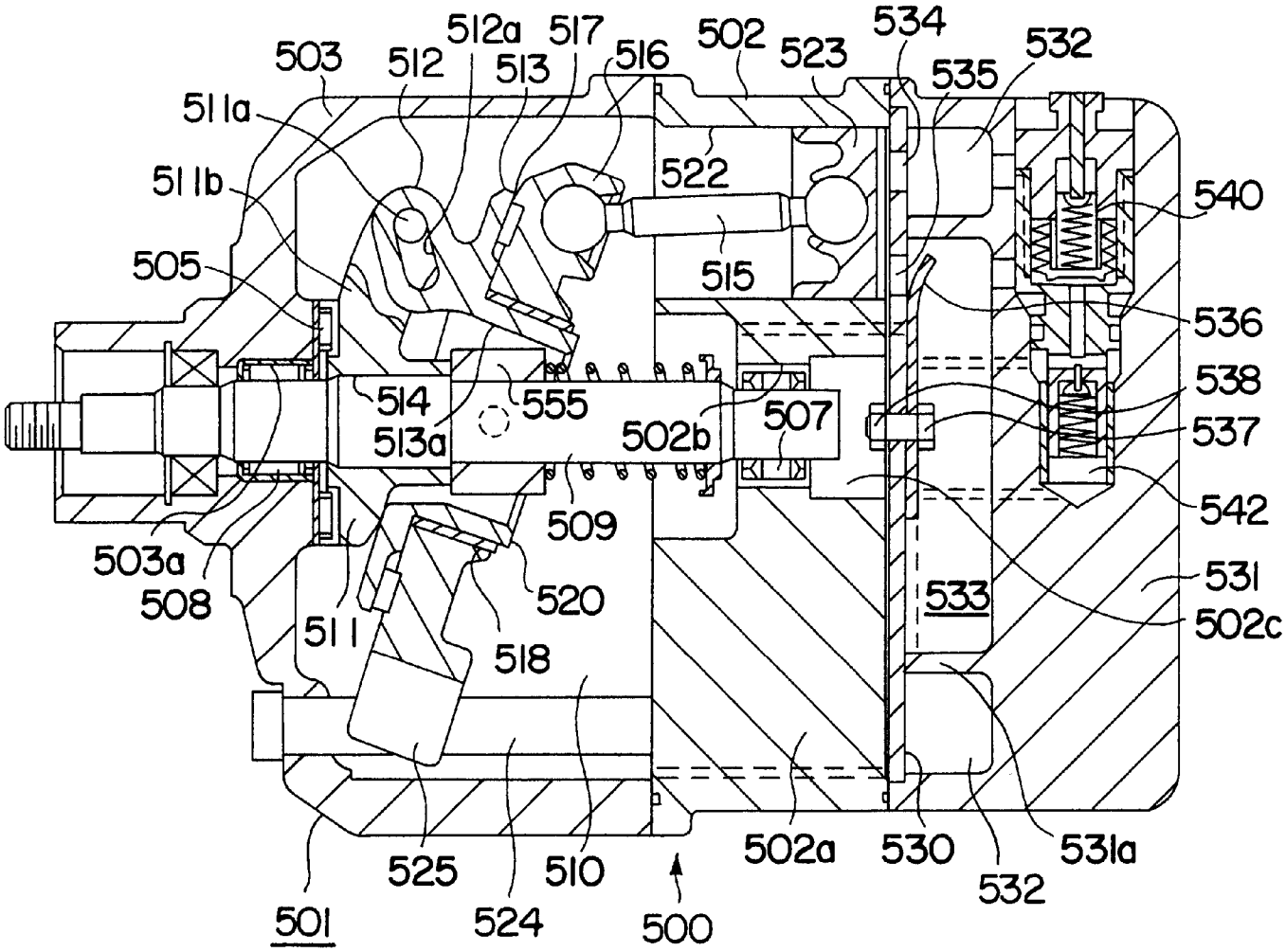
FIG. 2 PRIOR ART
FIG. 2 is a longitudinal cross-section view of a swash plate type refrigerant compressor in accordance with prior art.

The embodiments of the present invention are illustrated in FIGS. 3–17 wherein like numerals are used to denote elements which correspond to like elements depicted in FIGS. 1 and 2. A detailed explanation of several elements and characteristics of prior art compressors is provided above and, therefore, is omitted from this section.

Figure 3:
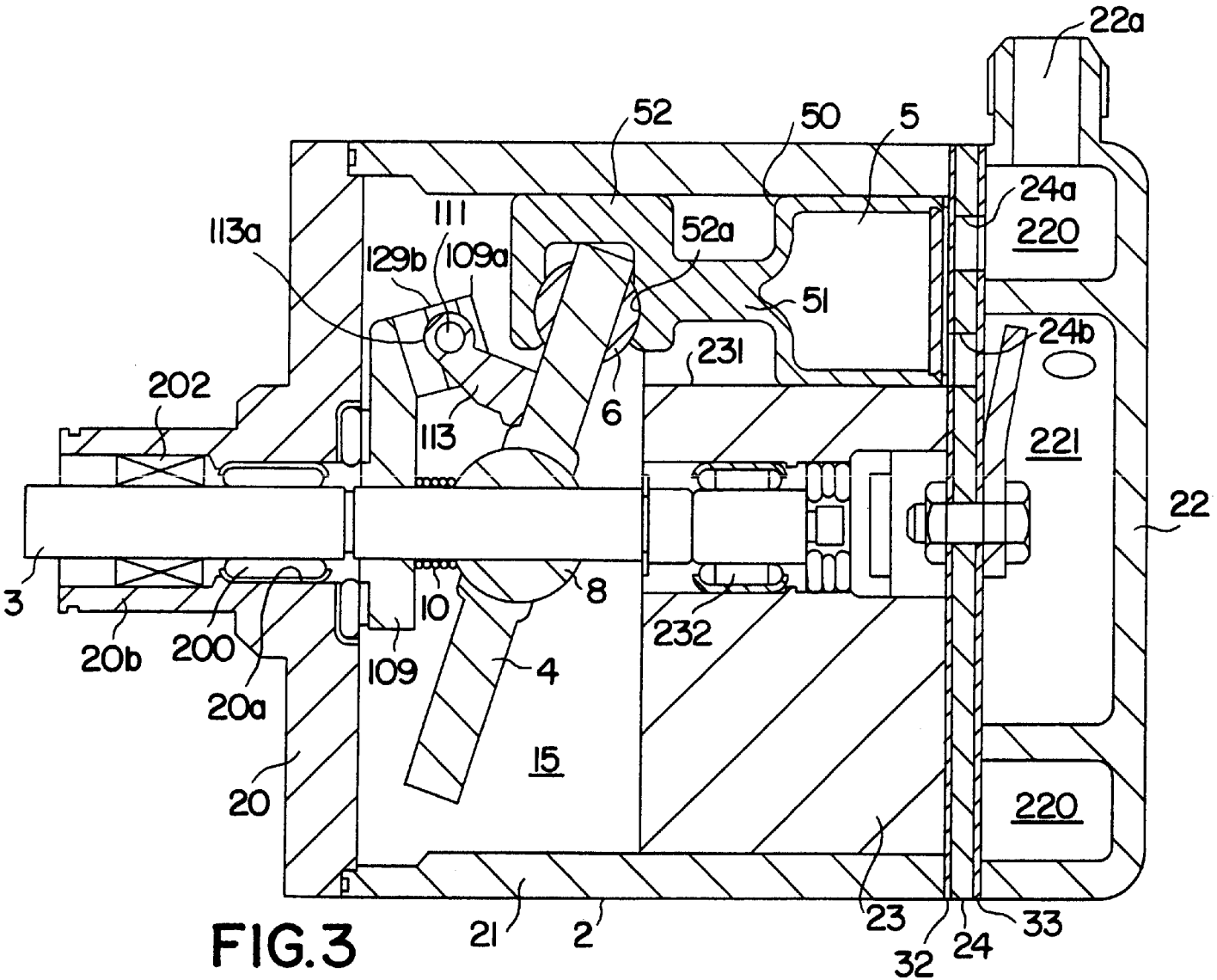
FIG. 3 is a longitudinal cross-section view of a swash plate refrigerant compressor in accordance with a first embodiment of the present invention.
Figure 4:
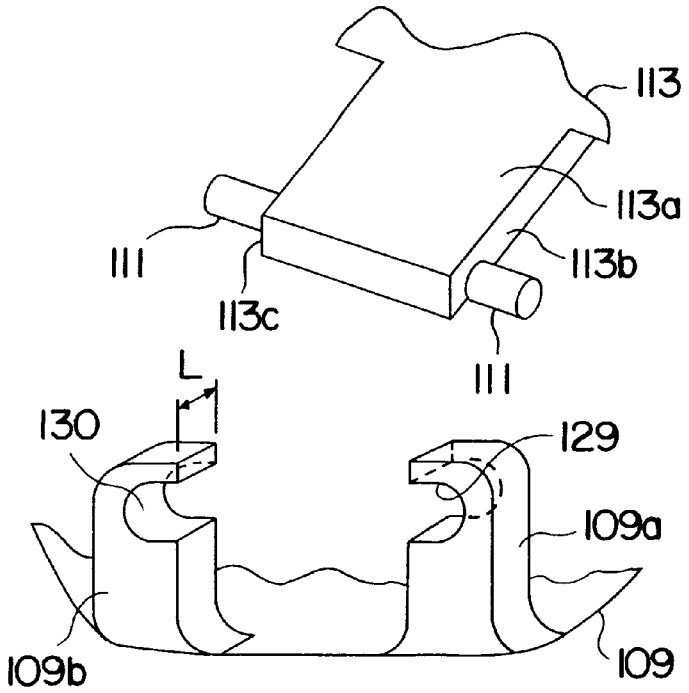
FIG. 4 is an exploded view of a hinge mechanism used in a swash plate refrigerant compressor in accordance with the first embodiment of the present invention.

Referring to FIGS. 3 and 4, an arm 113 extends from an end surface of swash plate 4. An arm portion 113*a*, which is defined by one end of arm 113, has pin members 111. Pin members 111 extend perpendicularly from radial side surfaces 113*c* and 113*d* of arm 113.

Rotor 109, which faces arm 113, has arms 109*a* and 109*b* formed at the edge of arm 113. Arms 109*a* and 109*b* engage with pin members 111. Arms 109*a* and 109*b* have grooves 129 and 130, respectively, that face each other. Grooves 129 and 130 have a half circle shape with an axial cross section. Pin members 111 engage to grooves 129 and 130 and is slidably disposed within grooves 129 and 130.

Referring to FIG. 4, the thickness of arms 109*a* and 109*b* of rotor 109 may be defined by "L". The size of the longitudinal axis of grooves 129 and 130 may be equal to thickness "L" of arms 109*a* and 109*b*, respectively.

In an embodiment, drive shaft 3 is rotated by a vehicle engine through a pulley arrangement. Rotor plate 109 is rotated with drive shaft 3. The rotation of rotor plate 109 is transferred to swash plate 4 by the hinge mechanism. Thus, the inclined surface of swash plate 4 moves axially to the right and left with the respect to the rotation of rotor plate 109. Torque transmitted from drive shaft 3 via the engine (not shown) is delivered to swash plate 4 for its nutational and rotational motion, accordingly. Arm 113 couples to rotor 109, such that pin members 111 engage to grooves 129 and 130. Pin members 111 are pinched and disposed between arms 109*a* and 109*b* of rotor 109, such that grooves 129 and 130 limit the locus of motion of swash plate 4. Piston 50 is connected to swash plate 4 by bearing shoes 6. Thus, piston 50 reciprocates within cylinder 231. As piston 50 reciprocates, refrigerant gas is introduced into suction chamber 220 from a fluid inlet port 22*a*, taken into cylinders 231 through suction ports 24*a*, and compressed. The compressed refrigerant is discharged through discharge ports 24*b* into discharge chamber 221 from cylinders 231. The compressed refrigerant is then released into an external fluid circuit, such as a cooling circuit through the fluid outlet port (not shown).

Thus, production of the hinge mechanism may be accomplished without an elongated slot formed in the arm portion of the swash plate and a snap ring. Further, assembly costs may be reduced because the arrangement has a hinge mechanism that has a pin and grooves. In contrast, an elongated slot may require a piercing process, which may incur higher costs. Further, during the compression and suction stage of the compressors, pin members 111 are axially subjected to the compression reaction force from piston 50. Further, the width of the groove of the arm of the rotor may be expanded in order to strengthen the engagement between pin members and the grooves.

Figure 5:
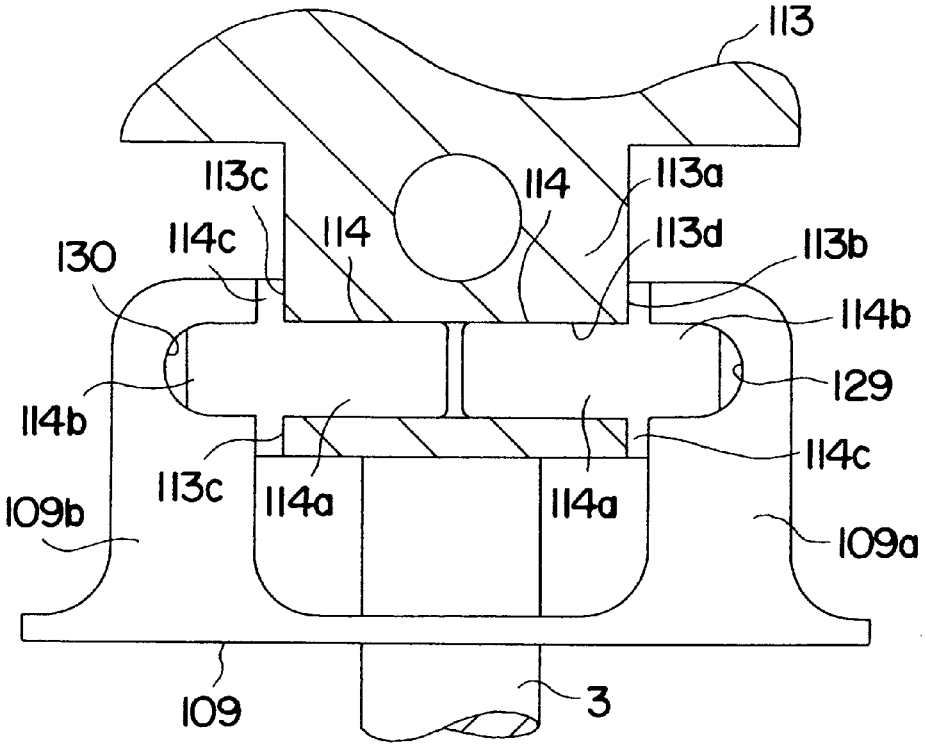
FIG. 5 is a partial, cross-section view of a hinge mechanism used in a swash plate refrigerant compressor in accordance with a second embodiment of the present invention.

FIG. 5 depicts a second preferred embodiment of the present invention. Arm portion 113*a* of arm 113 includes a hole 113*d*. Hole 113*d* penetrates from radial side surface 113*b* to radial side surface 113*c* of arm 113. A plurality of pin members 114 are inserted into both ends of hole 113*d*. Pin members 114 may be cylindrical in shape and have a cylindrical body 114*a*, a head portion 114*b*, and a flange 114*c* between cylindrical body portion 114*a* and head portion 114*b*. Flanges 114*c* of pin members 114 extends radially from the periphery surface of pin members 114. Pin members 114 may be inserted into hole 113*d* until flanges 114*c* strikes against radial side surfaces 113*c* and 113*d* of arm 113. Thus, pin members 114 protrude from radial side surfaces 113*c* and 113*d* of armn 113.

Noise and vibration may be caused by the gap created between hinge joint mechanism that joins arms 109*a* and 109*b* of rotor 109 to arm 113 of swash plate 4. This embodiment may reduce the noise and vibration because the semi-spherical surface of pin members 114 of swash plate 4 is in contact with the bottom surface of the groove of rotor 109.

Figure 6:
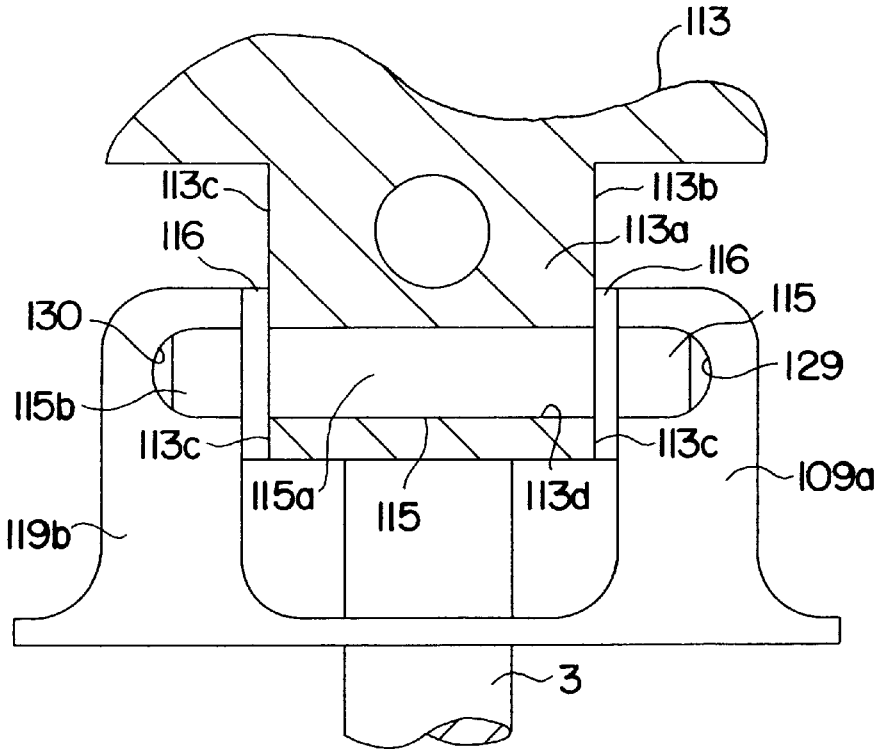
FIG. 6 is a partial, cross-section view of a hinge mechanism used in a swash plate refrigerant compressor in accordance with a third embodiment of the present invention.

FIG. 6 depicts a third embodiment of the present invention. A pin member 115 is inserted into hole 113*d*. Pin member 115 may be a cylindrical shape with a cylindrical body 115*a* and a head portion 115*b* formed at the both ends. Head portions 115*b* have a beveling at the edge corner for engaging along a curved bottom surface of grooves 129 and 130. Head portions 115*b* of pin member 115 protrude from radial side surface 113*b* and radial side surface 113*c*, respectively. A plurality of ring washers 116 encircle head portions 115*b* of pin member 115, such that head portions 115*b* penetrate openings of washers 116.

Figure 7:
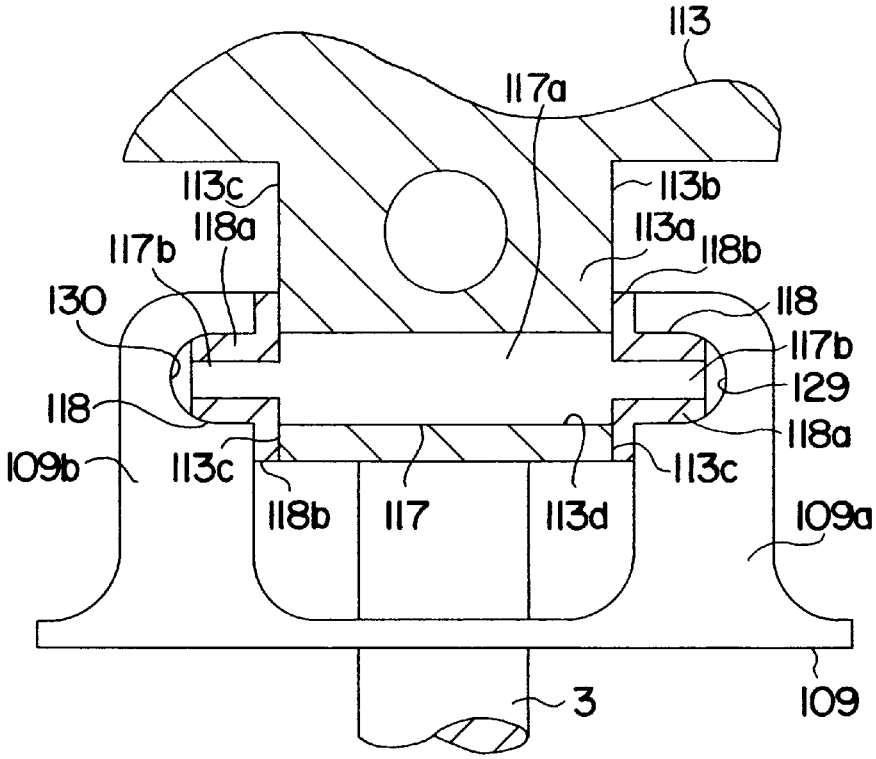
FIG. 7 is a partial, cross-section view of a hinge mechanism used in a swash plate refrigerant compressor in accordance with a fourth embodiment of the present invention.
Figure 8:
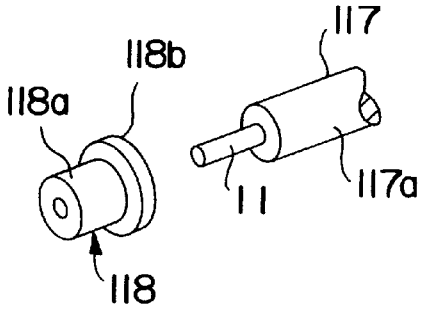
FIG. 8 is an exploded view of a cap member and pin member of a hinge mechanism used in a swash plate refrigerant compressor in accordance with the fourth embodiment of the present invention.

FIGS. 7 and 8 depict a fourth embodiment of the present invention. Pin member 117 has a cylindrical body 117*a* and head portions 117*b* that extend axially from both ends of cylindrical body 117*a*. Head portions 117*b* may have an outside diameter smaller than that of cylindrical body 117*a*. A pin member 117 may be inserted into hole 113*b* such that head portions 117*b* protrude from radial side surface 113*b* and radial side surface 113*c*, respectively. Cap members 118*b*, each having a cylindrical body 118*a*, extend radially from the periphery surface of cylindrical bodies 118*a*. Opening 118*c* penetrates through the center of cap members 118. Thus, head portions 117*a* penetrate through opening 118*c* of cap members 118. Cylindrical portions 118*a* of cap members 118 may have a beveling at the edge corner for engaging along a curved bottom surface of grooves 129 and 130. Therefore, cap members 118 engage to grooves 129 and 130 of arm portion 109 so as to be slidably disposed within grooves 129 and 130. Accordingly, cap members 118 are placed between grooves 129*a* and 130 of arm portion 109.

Figure 9:
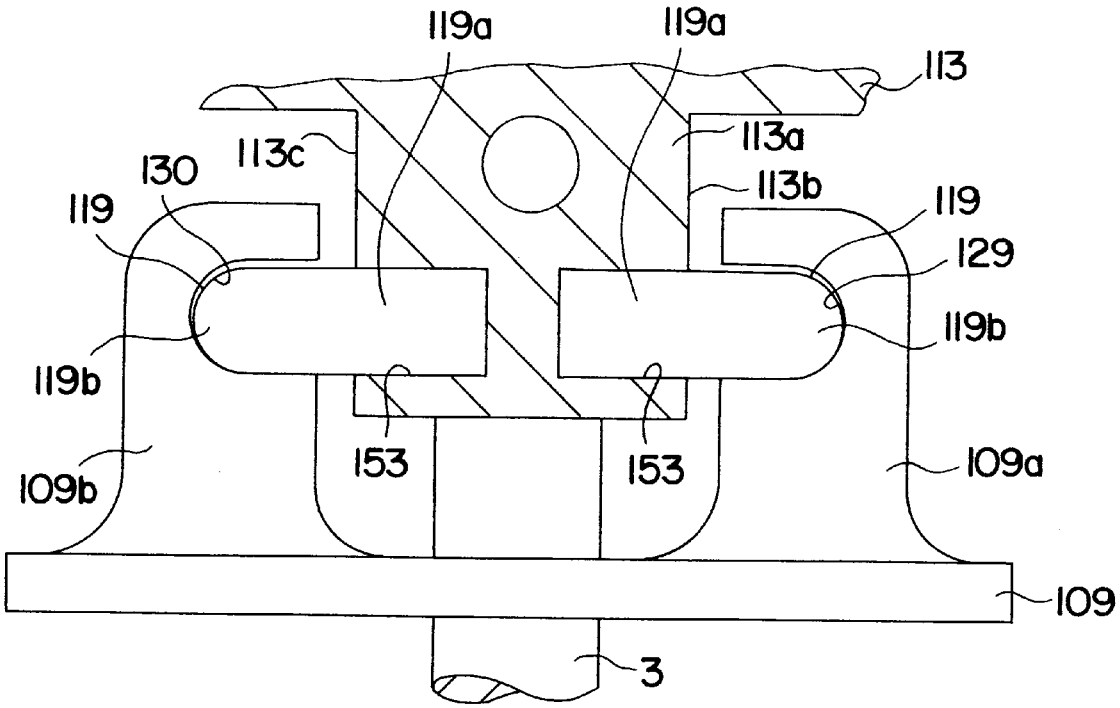
FIG. 9 is a partial, cross-section view of a hinge mechanism used in a swash plate refrigerant compressor in accordance with a fifth embodiment of the present invention.

FIG. 9 depicts a fifth embodiment of the present invention. Arm 113 has a pair of apertures 153 on radial side surface 113*b* and radial side surface 113*c* of arm 113. Apertures 153 have a depth to accommodate pin members 119. Pin members 119 may have cylindrical bodies 119*a* and hemisphere portions 119*b*. Pin members 119 are inserted into aperture 153 until pin member 119 fill aperture 153.

Hemisphere portions 119*b* of pin members 119 protrude from radial side surface 113*b* and radial side surface 113*d* of arm 113. Each of pin members 119 engages to grooves 129 and 130 of arm portions 109 so as to be slidably disposed within grooves 129 and 130. Further, the distance between a pair of arms 109*a* and 109*b* may be greater than the width of arm portion 113*a*.

Figure 10:
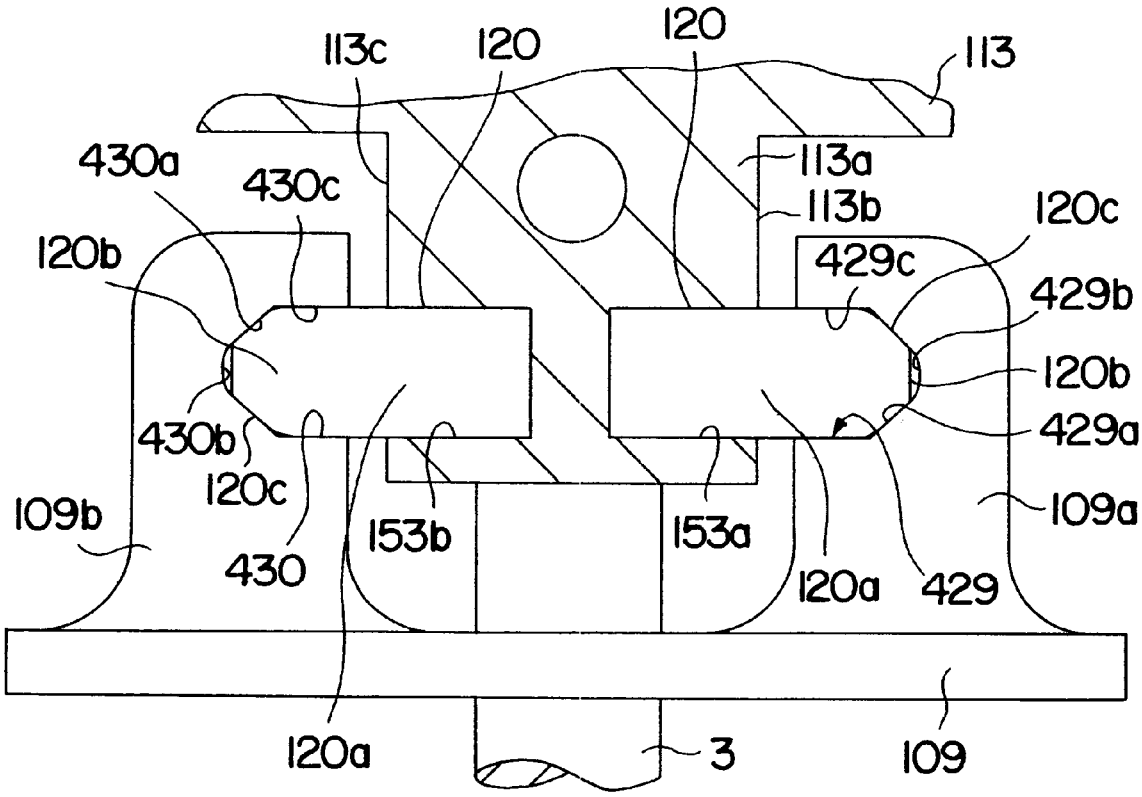
FIG. 10 is a partial, cross-section view of a hinge mechanism used in a swash plate refrigerant compressor in accordance with a sixth embodiment of the present invention.
Figure 11:
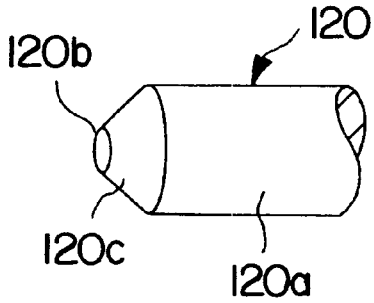
FIG. 11 is an exploded view of a pin member of a hinge mechanism used in a swash plate refrigerant compressor in accordance with the sixth embodiment of the present invention.

FIGS. 10 and 11 depict a sixth embodiment of the present invention. Pin members 120 may have a cylindrical body 120*a* and a head portion 120*b*. Head portion 120*b* may have a C-cut surface 120*c* or, alternatively, an inclined surface at the corner edge of head portion 120*b*. Further, engaging portions 109*a* and 109*b* may have grooves 429 and 430. Grooves 429 and 430 may have a pair of inclined surfaces 429*a* and 430*a*, a pair of bottom flat surfaces 429*b* and 430*b*, and a pair of side surfaces 429*c* and 430*c*. Thus, grooves 429 and 430 correspond to C-cut surfaces 120*c*. Pin members 120 engage with grooves 429 and 430. Therefore, rotor 109 is coupled to swash plate 4 through the hinge mechanism composed of pin members 120 and grooves 429 and 430.

Figure 12:
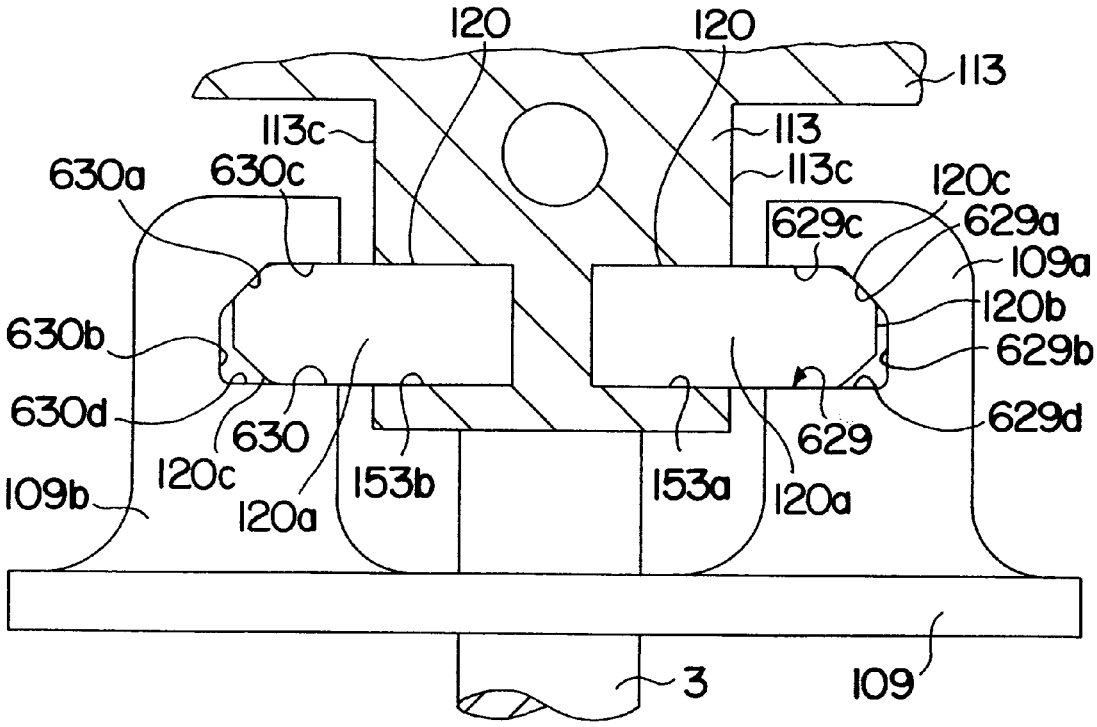
FIG. 12 is a partial, cross-section view of a hinge mechanism used in a swash plate refrigerant compressor in accordance with a seventh embodiment of the present invention.
Figure 13:
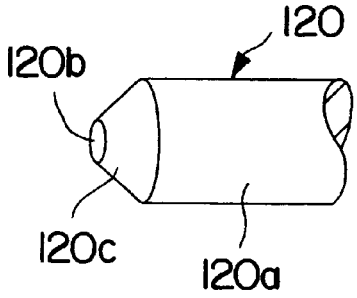
FIG. 13 is an exploded view of a pin member of a hinge mechanism used in a swash plate refrigerant compressor in accordance with the seventh embodiment of the present invention.

FIGS. 12 and 13 depict a seventh embodiment of the present invention. Arms 109*a* and 109*b* may have grooves 629 and 630, respectively. Grooves 629 and 630 have inclined surfaces 629*a* and 630*a*, bottom flat surfaces 629*b* and 630*b*, first side surfaces 629*c* and 630*c*, and second side surfaces of 629*d* and 630*d*. The shape of grooves 629 and 630 correspond to the shape of head portions 120*b* of pin members 120. Thus, pin members 120 engage with grooves 629 and 630. Therefore, rotor 109 is coupled to swash plate 4 through the hinge mechanism composed of pin members 120 and grooves 629 and 630.

Figure 14:
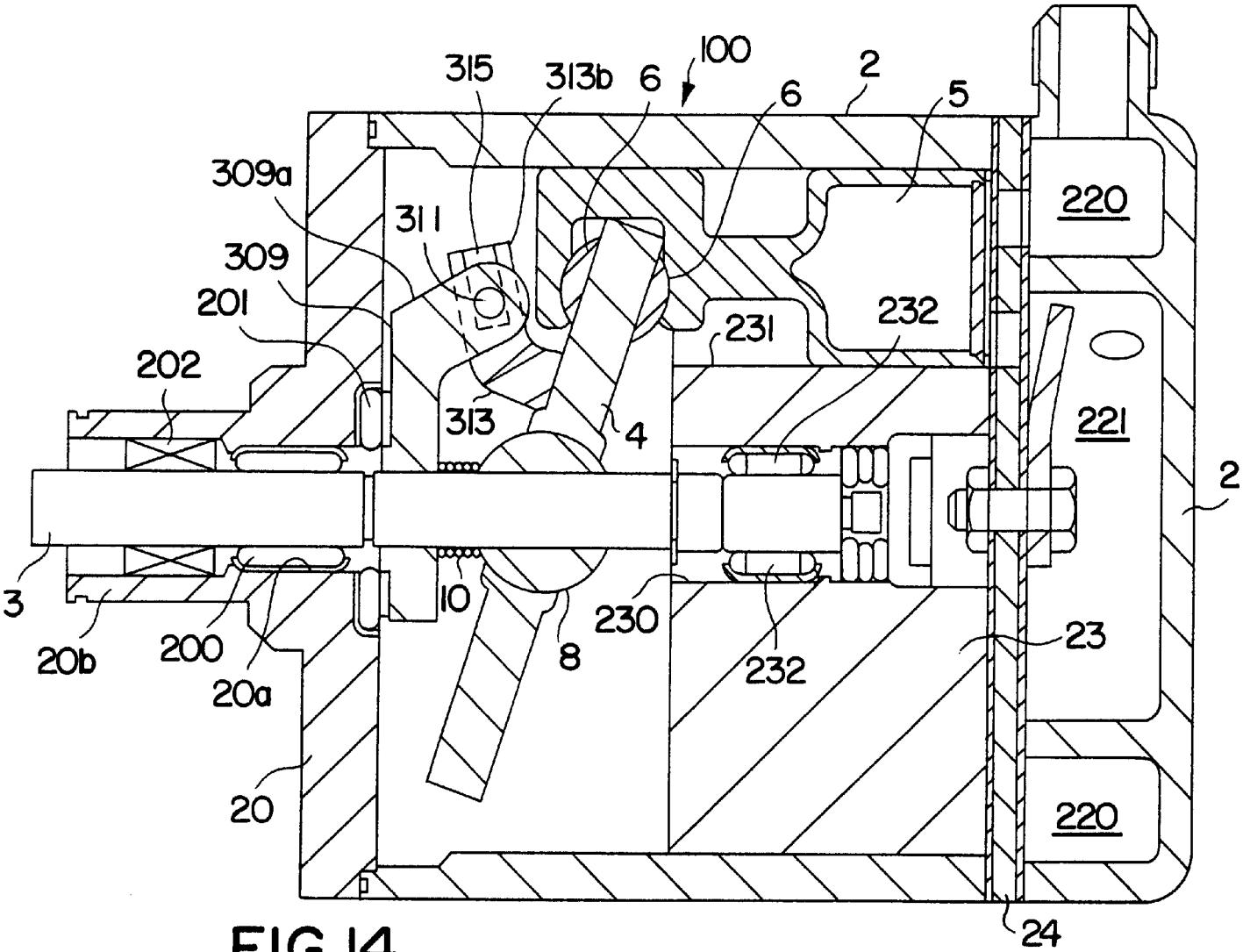
FIG. 14 is a longitudinal cross-section view of a swash plate refrigerant compressor in accordance with an eighth embodiment of the present invention.
Figure 15:
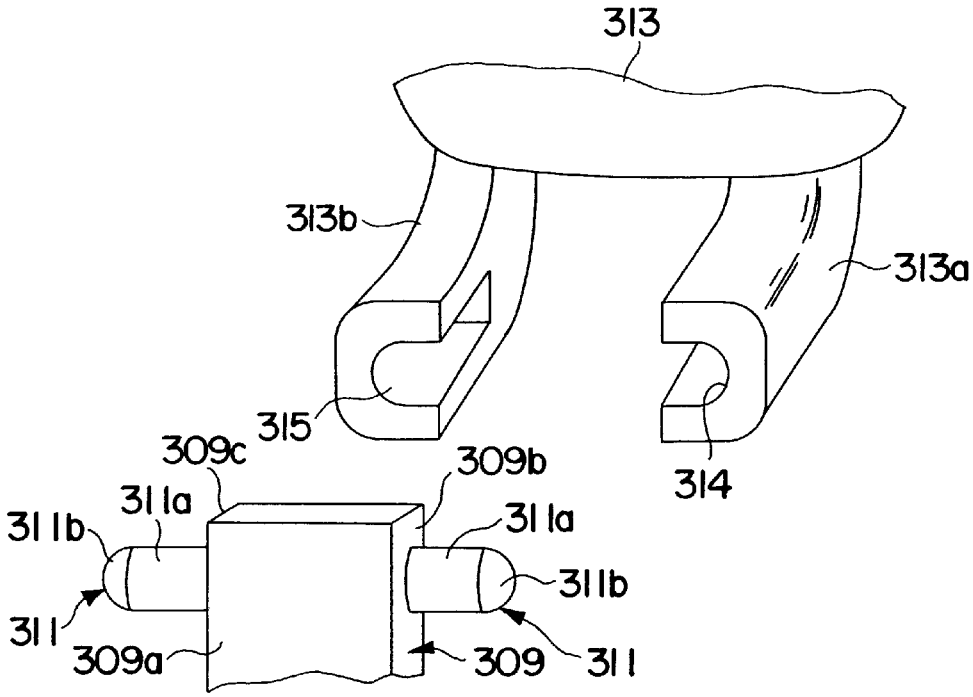
FIG. 15 is an exploded view of a hinge mechanism used in a swash plate refrigerant compressor in accordance with the eighth embodiment of the present invention.

FIGS. 14 and 15 depict an eighth embodiment of the present invention. In this embodiment, the hinge mechanism is reverse of the one in the embodiments disclosed in FIGS. 1–13. Arm 313 of swash plate 4 may have arm portions 313*a* and 313*b* paralleling each other Arm portions 313*a* and 313*b* may have grooves 314 and 315, respectively. Grooves 314 and 315 may have a U-shape cross section. Referring to FIG. 15, rotor 309 has an arm 309*a*. Arm 309*a* may have pin members 311. Pin members 311 may have a cylindrical body 311*a* and a head portion 311*b*. Pin members 311 extend perpendicularly from arm 309*a* of rotor 309. Thus, pin members 311 are engaged with grooves 314 and 315, such that pin members 311 slide in grooves 314 and 315. Therefore, rotor 309 is coupled to swash plate 4 through the hinge mechanism composed of pin members 311 and grooves 314 and 315 of arm portions 313*a* and 313*b*.

Figure 16:
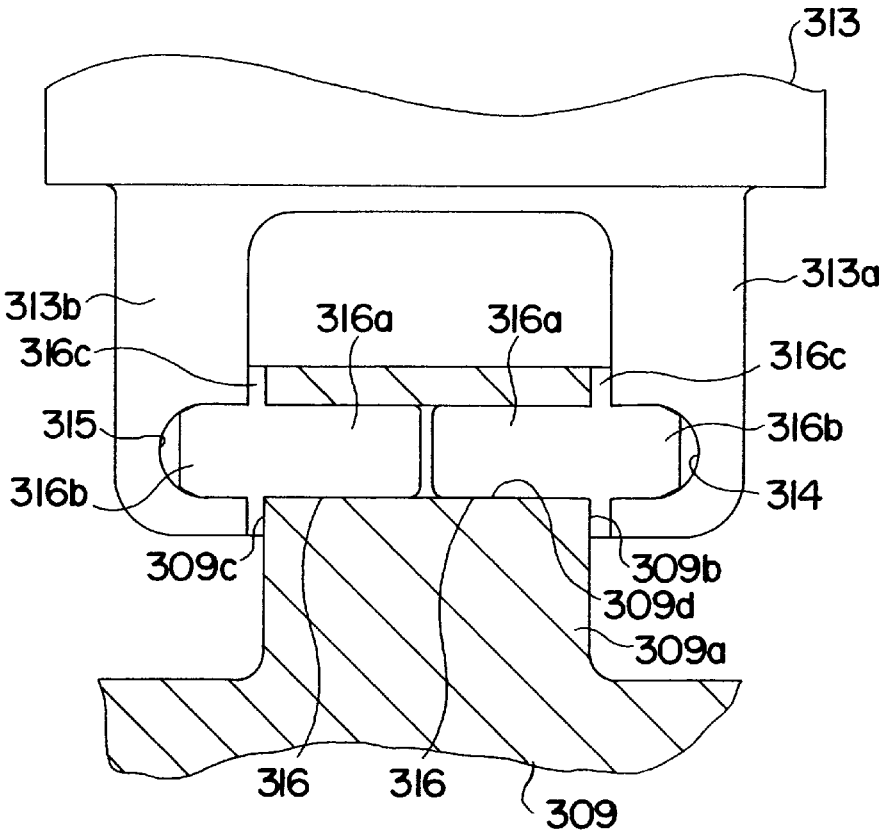
FIG. 16 is a partial, cross-section view of a hinge mechanism used in a swash plate refrigerant compressor in accordance with a ninth embodiment of the present invention.

FIG. 16 depicts a ninth embodiment of the present invention. Arm 309*a* of rotor 309 has a hole 309*d* that penetrates from radial side surface 309*b* to radial side surface 309*c*. Pin members 316 are inserted into hole 309*d*. Pin members 316 may have a cylindrical body 316*a*, a head portion 316*b*, and a flange 316*c*. Flanges 316*c* of pin members 316 extend radially from the periphery surface of pin members 316. Pin members 316 insert into hole 309*d* until flange 316*c* strikes against radial side surfaces 309*b* and 309*c*. Thus, pin members 316 protrude from radial side surfaces 309*b* and 309*c*.

Figure 17:
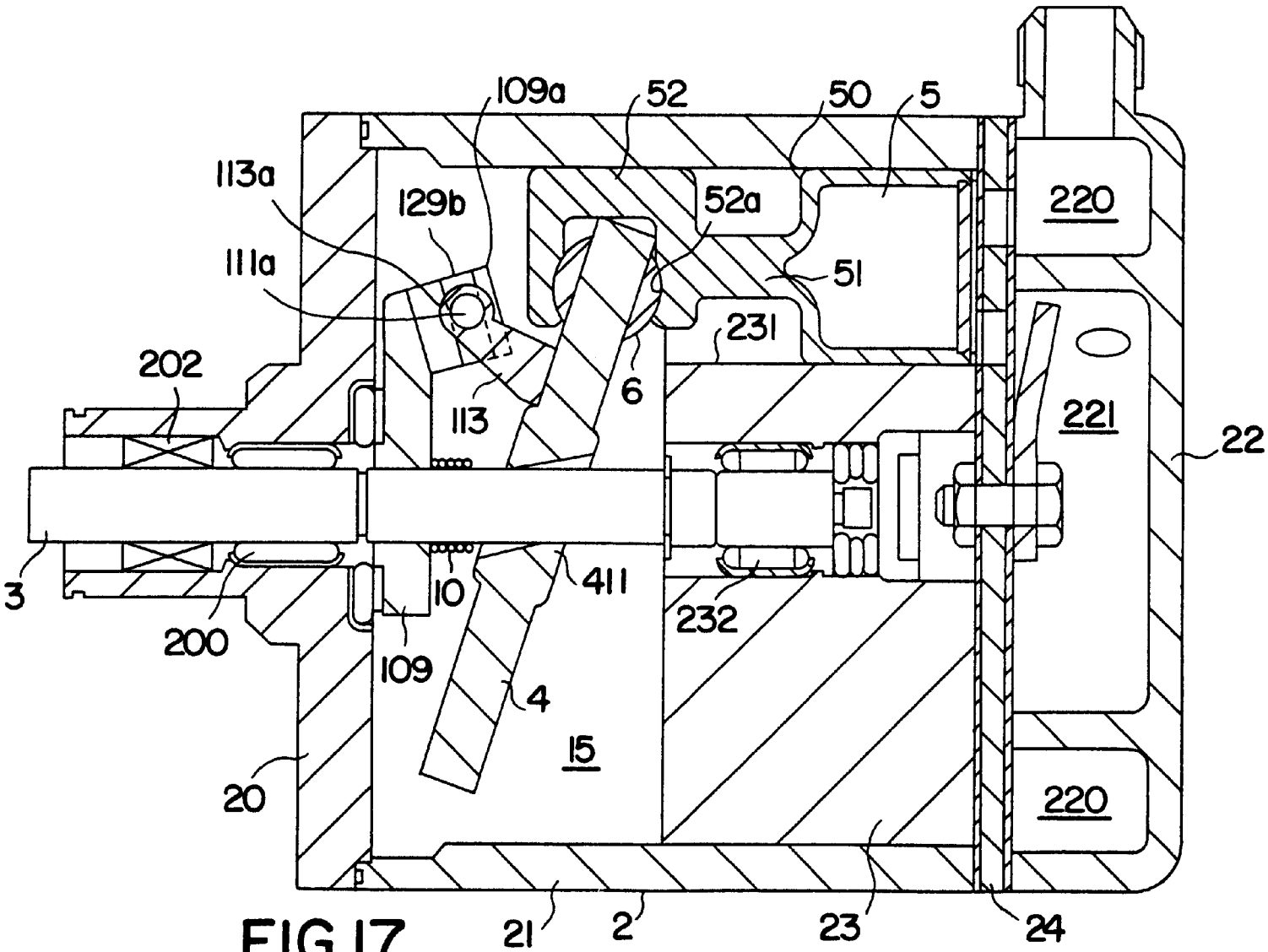
FIG. 17 is a longitudinal cross-section view of a swash plate refrigerant compressor in accordance with the present invention.

Referring to FIG. 17, a swash plate compressor is depicted for use in accordance with the present invention. In this embodiment, no bush 8 is placed between swash plate 4 and drive shaft 3, as disclosed in FIG. 3. Swash plate 4 may have a penetrating hole 411 that allows drive shaft 3 to penetrate swash plate 4.

Although the preferred embodiments disclose the invention as a swash plate compressor, the invention is not restricted to swash plate refrigerant compressors, but may be employed in a wobble plate type compressor, or a piston type fluid displacement apparatus with a variable displacement mechanism. Accordingly, the embodiments and features disclosed herein are provided by way of example only. It will be easily understood by those of ordinary skill in the art that variations and modifications can be easily made within the scope of this invention as defined by the following claims.

What is claimed is:

1. A fluid displacement apparatus comprising:

a housing enclosing a crank chamber, a suction chamber, and a discharge chamber;

a plurality of cylinders in said housing;

a plurality of pistons, each of which is slidably disposed within each one of said cylinders; wherein said pistons reciprocate within said cylinders;

a drive shaft rotatably supported in said housing;

a cam rotor connected to said drive shaft and having a first arm extending therefrom;

a plate tiltably connected to said drive shaft, having a surface disposed at an adjustable inclined angle relative to a plane perpendicular to said drive shaft and having a second arm extending therefrom;

a coupling means for coupling said plate to said pistons, wherein said pistons are driven in reciprocating motion within said cylinders upon nutation of said plate;

a plurality of pin members each having an axis, said axis being tangential to a circular locus formed by a rotation of said pin members; and engaging means in said cam rotor wherein said pin member is disposed slidably to a direction that is perpendicular to said pin member in said engaging means, and said cam rotor is coupled to said slant angle for varying the inclination of said slant plate.

2. The fluid displacement apparatus of claim 1, wherein said engaging means is a groove formed on said first arm of said cam rotor.

3. A fluid displacement apparatus comprising:

a housing enclosing a crank chamber, a suction chamber, and a discharge chamber, a plurality of cylinders in said housing;

a plurality of pistons, each of which is slidably disposed within each one of said cylinders; wherein said pistons reciprocate within said cylinders;

a drive shaft rotatablv supported in said housing;

a cam rotor connected to said drive shaft and having a first arm extending therefrom;

a plate tiltably connected to said drive shaft, having a surface disposed at an adjustable inclined angle relative to a plane perpendicular to said drive shaft and having a second arm extending therefrom;

a coupling means for couling said plate to said pistons, wherein said pistons are driven in reciprocating motion within said cylinders upon nutation of said plate;

a pin member disposed in said second arm of said plate; and engaging means in said cam rotor wherein said pin member is slidably disposed in said engaging means, and said cam rotor is coupled to said slant angle for varying the inclination of said slant plate; wherein said engaging means is a groove formed on said first arm of said cam rotor, and wherein said pin member comprises a half-spherical surface, and said groove comprises a surface having a half-circular shape for contacting with said half-spherical surface of said pin member.

4. A fluid displacement apparatus comprising:

a housing enclosing a crank chamber, a suction chamber, and a discharge chamber;

a plurality of cylinders in said housing;

a plurality of pistons, each of which is slidably disposed within each one of said cylinders; wherein said pistons reciprocate within said cylinders;

a drive shaft rotatably supported in said housing;

a cam rotor connected to said drive shaft and having a first arm extending therefrom;

a plate tiltably connected to said drive shaft, having a surface disposed at an adjustable inclined angle relative to a plane perpendicular to said drive shaft and having a second arm extending therefrom;

a coupling means for coupling said plate to said pistons, wherein said pistons are driven in reciprocating motion within said cylinders upon nutation of said plate;

a pin member disposed in said second arm of said plate; and engaging means in said cam rotor wherein said pin member is slidably disposed in said engaging means and, said cam rotor is coupled to said slant angle for varying the inclination of said slant plate; wherein said engaging means is a groove formed on said first arm of said cam rotor, and wherein said pin member comprises a tapered curved surface, and said groove having a pair of inclined surfaces facing each other for contacting with said tapered curved surface of said pin member.

5. A fluid displacement apparatus comprising:

a housing enclosing a crank chamber, a suction chamber, and a discharge chamber;

a plurality of cylinders in said housing;

a plurality of pistons, each of which is slidably disposed within each one of said cylinders; wherein said pistons reciprocate within said cylinders;

a drive shaft rotatable supported in said housing;

a cam rotor connected to said drive shaft and having a first arm extending therefrom;

a plate tiltably connected to said drive shaft, having a surface disposed at an adjustable inclined angle relative to a plane perpendicular to said drive shaft and having a second arm extending therefrom;

a coupling means for coupling said plate to said pistons, wherein said pistons are driven in reciprocating motion within said cylinders upon nutation of said plate;

a pin member disposed in said second arm of said plate; and engaging means in said cam rotor wherein said pin member is slidably disposed in said engaging means, and said cam rotor is coupled to said slant angle for varying the inclination of said slant plate; wherein said engaging means is a groove formed on said first arm of said cam rotor, and wherein said pin member comprises a tapered curved surface, and said groove having an inclined surface and a flat surface perpendicular to an axis of said pin member for contacting said tapered curved surface of said pin member.

6. The fluid displacement apparatus of claim 1, wherein said second arm of said plate comprises at least one aperture, and said pin member is disposed in said at least one aperture.

7. The fluid displacement apparatus of claim 1, wherein said pin member comprises a pair of pins.

8. A fluid displacement apparatus comprising:

a housing enclosing a crank chamber, a suction chamber, and a discharge chamber;

a plurality of cylinders in said housing;

a plurality of pistons, each of which is slidably disposed within each one of said cylinders; wherein said pistons reciprocate within said cylinders;

a drive shaft rotatable supported in said housing;

a cam rotor connected to said drive shaft and having a first arm extending therefrom;

a plate tiltably connected to said drive shaft having a surface disposed at an adjustable inclined angle relative to a plane perpendicular to said drive shaft and having a second arm extending therefrom;

a coupling means for coupling said plate to said pistons, wherein said pistons are driven in reciprocating motion within said cylinders upon nutation of said plate;

a pin member disposed in said second arm of said plate; and engaging means in said cam rotor wherein said pin member is slidably disposed in said engaging means, and said cam rotor is coupled to said slant angle for varying the inclination of said slant plate;

wherein said pin member comprises flange portions extending perpendicularly from a periphery surface of said pin member, wherein said flange portions are disposed between said first arm of said cam rotor and said second arm of said plate.

9. The fluid displacement apparatus of claim 1, further comprising at least one washer member which is penetrated by said pin member, and is disposed between said first arm of said cam rotor and said second arm of said plate.

10. The fluid displacement apparatus of claim 1, further comprising a plurality of cap members, which cover said pin member and are disposed in said engaging means.

* * * * *